United States Patent [19]

Pasquier

[11] Patent Number: 4,798,012

[45] Date of Patent: Jan. 17, 1989

[54] PNEUMATIC PROCESS AND DEVICE FOR CONVEYING SNOW

[75] Inventor: Armand Pasquier, F-74000, Annecy, France

[73] Assignees: Etudes Techniques et Realisations (CdF Ingenierie); Armand Pasquier, both of France

[21] Appl. No.: 35,765

[22] Filed: Apr. 8, 1987

[30] Foreign Application Priority Data

Apr. 15, 1986 [FR] France ..... 86 05339

[51] Int. Cl.[4] ..... E01H 8/04

[52] U.S. Cl. ..... 37/219; 37/197; 37/223; 272/56.5 SS

[58] Field of Search ..... 37/197, 219, 221, 222, 37/223; 239/2 S; 272/56.5 SS

[56] References Cited

U.S. PATENT DOCUMENTS

| | | | |
|---|---|---|---|
| 4,050,169 | 9/1977 | Pasquier | 37/197 |
| 4,174,578 | 11/1979 | Grillo | 37/221 |
| 4,288,931 | 9/1981 | Rhodes | 37/197 |
| 4,404,762 | 9/1983 | Munsterer | 37/219 |
| 4,538,369 | 9/1985 | Pasquier | 37/219 |

FOREIGN PATENT DOCUMENTS

| | | |
|---|---|---|
| 1117491 | 5/1956 | France . |
| 2262155 | 9/1975 | France . |
| 2422771 | 4/1981 | France . |

*Primary Examiner*—Eugene H. Eickholt

*Attorney, Agent, or Firm*—Finnegan, Henderson, Farabow, Garrett & Dunner

[57] ABSTRACT

The technical field of the invention is that of pneumatic snow conveying.

The invention relates to a process and device for translational conveying of a pile of snow for the purpose of its being cut off by a drawoff device forming a stationary unit which is associated with the other devices of the pneumatic conveying apparatus.

The rate of conveying is controlled by a servo device and the height of the pile of snow is controlled by a crest-trimming device.

19 Claims, 3 Drawing Sheets

PNEUMATIC PROCESS AND DEVICE FOR CONVEYING SNOW

FIELD OF THE INVENTION

The present invention relates to a pneumatic process and device for conveying natural or artificial snow, intended for the application or removal of snow or for firefighting, and more particularly the conditions for drawing off snow.

BACKGROUND OF THE INVENTION

From French Pat. Nos. 2,289,414 and 2,327,172 it is known to apply snow to skiing sites by drawing off snow from a pile and conveying it pneumatically towards the site of use by means of a duct. The equipment described in these patents comprises a fan feeding air into a conveying duct in which a snow injector is provided. The plant associated with the conveying duct may be stationary, the snow drawoff device, the injector and the air generator being permanently placed at their site of use. The plant may also be movable and may comprise the same devices mounted on a vehicle. The snow drawoff device described always moves in a pile of snow or a layer of snow which is stationary. This is either a screw cutting off piled snow in conical slices of various apex angles, one end being integrally secured to an articulated attachment point, the other end describing circles of increasing radius, or a screw mounted on a movable trolley cutting off piled snow in successive transverse slices, or a drawoff device capable of travelling over snow by being mounted on a vehicle.

In document FR-A-2,327,172, the drawoff device placed at the head of the stationary plant conduit refers to that described in the claims of patent FR-A-2,289,414, as described above. Thus, these patents describe a system for drawing off snow wherein the pile of snow or the layer of snow is stationary, and the drawoff device must move, this also being the case in the plant referred to as stationary.

The same applies to French Pat. No. 2,422,771, where the drawoff device, consisting of a cutter or turbo-cutter, moves on an arm which can be directed.

This is also the case in European Patent Application No. 106,731, where only the air generator can form a stationary unit, the drawoff device being always associated with the vehicle for cutting off the pile or the layer of snow, which remains stationary.

The drawoff device consisting of screws such as those described in patent FR-A-2,289,414, does not make it possible to provide sealing between the internal space of the duct and the atmosphere, where the air pressures are different. This results in a mediocre pneumatic efficiency due to the leakages of air from the inside of the duct outwards. The construction involves fairly complex machinery. It is known, furthermore, that snow is a material which rapidly gives rise to a cramming phenomena, and hence to blocking, in the conveying screws.

The drawoff device consisting of a snow cutter or of a turbo-cutter with a single or double drum is efficient, but it has always been considered for use while it travels over the pile or the layer of snow by virtue of a vehicle. This arrangement requires a tracked vehicle capable of travelling over snow, which is high in cost and which is made very difficult to drive by the need to cut the snow off in a uniform manner.

Since this result is very difficult to achieve, it leads to a very nonuniform flow of snow in the duct. This is reflected in a risk of cramming and an actual mean rate of conveying which is much lower than the theoretical maximum output of the plant. This relatively low conveying rate is also due to the losses of time due to the maneuvering of the vehicle.

The use of a wheeled vehicle for moving the drawoff device in the operations of snow removal by pneumatic conveying involves the same disadvantages as those described above.

SUMMARY OF THE INVENTION

It is an object of the present invention is to overcome these disadvantages.

For this purpose, the invention relates to a pneumatic process and device for conveying snow, comprising conveying equipment permitting a pile of snow to be moved towards a drawoff and clod-breaking device forming a stationary unit, the drawoff device being combined with an injector which is also stationary. Thus, this process and device make it possible to control the thickness of the snow ingested by the drawoff device, as well as the rate of conveying and, consequently, the output of snow to be introduced into the conveying duct.

A subject of the present invention includes a pneumatic process for conveying snow comprising at least one prime mover driving an air generator, a device for injecting snow into the conveying duct producing a mixture of air and snow, the latter originating from a drawoff device, driving means for driving the said injection and drawoff devices which are connected to or are independent of the said prime mover, wherein the said devices for injecting and drawing off snow form a stationary unit, and in that a pile of snow is moved towards the drawoff device by a conveying means at a rate of travel and in a thickness which are controlled.

Another subject of the invention consists of a device for implementing the process, comprising at least one prime mover driving an air generator, at least one snow injection device associated with a conveying duct producing a mixture of air and snow, at least one drawoff device, driving means for driving the said devices which are connected to or independent of the said prime mover, characterized in that the said injection and drawoff devices form a stationary unit and in that it additionally comprises a conveying means moving the pile of snow in translation towards the drawoff device and a crest-trimming device for controlling the thickness of the pile of snow reaching the drawoff device.

Additional objects and advantages of the invention will be set forth in part in the description that follows, and in part will be obvious from the description or may be learned by practice of the invention. The objects and advantages of the invention may be realized and attained by means of the procedures and combinations particularly pointed out in the appended claims.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Figure 1:
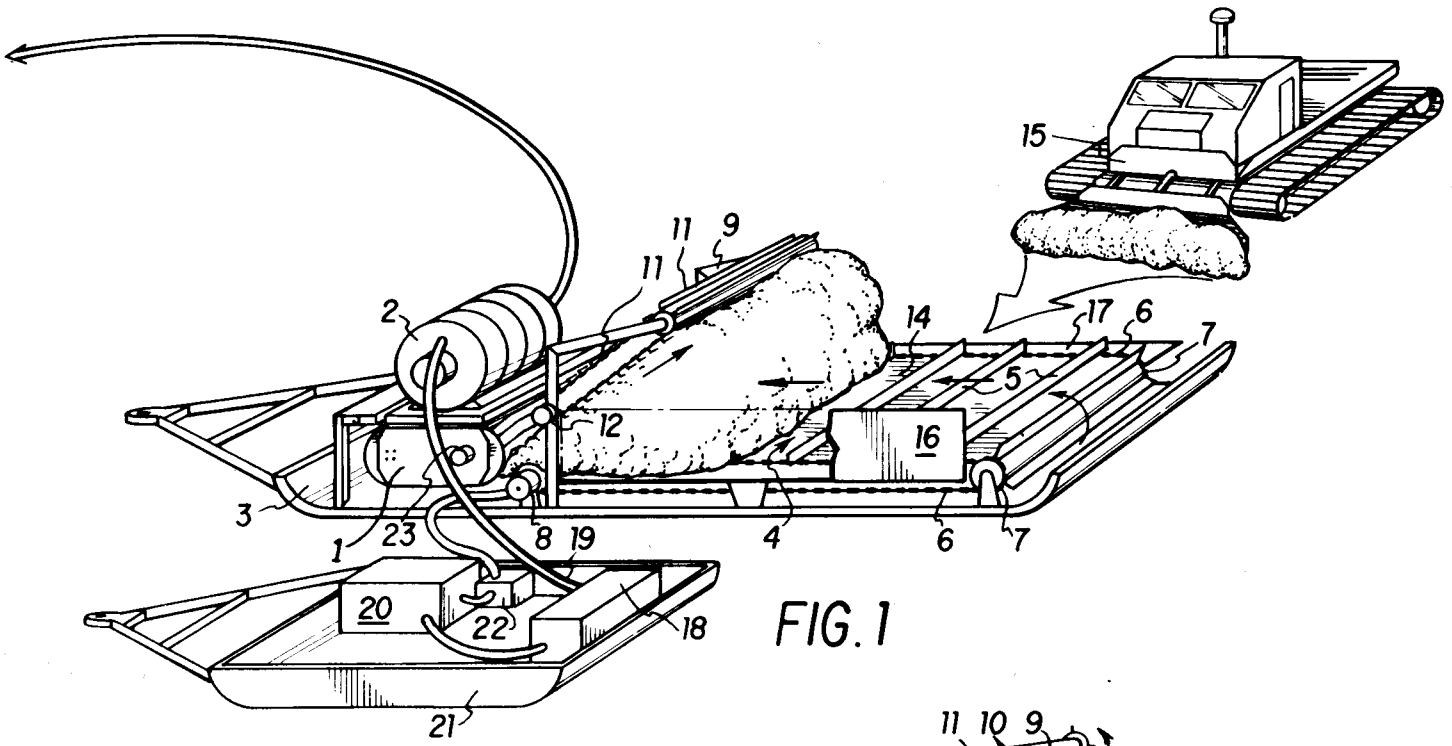
FIG. 1 is a perspective view of a preferred embodiment of the invention, depicted with other devices at a work site. The rack is shown in fragmentary view.

The invention relates to a pneumatic process and device for conveying snow, comprising, conveying equipment permitting a pile of snow to be moved towards a drawoff and clod-breaking device forming a stationary unit, the drawoff device being combined with an injector which is also stationary. Thus, this process and device make it possible to control the thickness of the snow ingested by the drawoff device, as well as the rate of conveying and, consequently, the output of snow to be introduced into the conveying duct.

A subject of the present invention includes a pneumatic process for conveying snow comprising at least one prime mover driving an air generator, a device for injecting snow into the conveying duct producing a mixture of air and snow, the latter originating from a drawoff device, driving means for driving the said injection and drawoff devices which are connected to or are independent of the said prime mover, wherein the said devices for injecting and drawing off snow form a stationary unit, and in that a pile of snow is moved towards the drawoff device by a conveying means at a rate of travel and in a thickness which are controlled.

The injection and drawoff devices are, for example, respectively, a rotary lock and a cutter such as are described in the abovementioned patents. The snow is delivered onto the conveying device either by being pushed by the blade of a ramming vehicle, for example, or is conveyed by a public works vehicle of the "loader" type.

Another subject of the invention includes a device for implementing the process, comprising at least one prime mover driving an air generator, at least one snow injection device associated with a conveying duct producing a mixture of air and snow, at least one drawoff device, driving means for driving the devices which are connected to or independent of the said prime mover, wherein the injection and drawoff devices form a stationary unit and in that it additionally comprises a conveying means moving the pile of snow in translation towards the drawoff device and a crest-trimming device for controlling the thickness of the pile of snow reaching the drawoff device.

The means for conveying the pile of snow may consist of a conveyor belt equipped with transverse grips for driving the pile of snow and with means for driving the conveyor belt.

The conveying means may also consist of transverse grips for driving the snow, sliding on a stationary floor and driven by two side chains actuated by driving means.

The conveying means are driven by driving means forming part of a unit which comprises mechanical transmissions, hydraulic transmissions, electrical transmissions and mixed transmissions.

When the drawoff device is of the snow-cutter or turbo-cutter type, the drawoff drum is preferably placed tangentially to the plane of conveying of the pile of snow.

The driving means ensure that the conveying means move in translation at either a noncontinuous rate, referred to as stepwise, or at a steady, continuous rate. In both cases, the value of the rate is regulated and controlled as a function of the power consumed by the drawoff device, the latter depending on the consistency of the snow and constituting one or more set values for control by means of continuous or discontinuous action.

For example, in the case of a hydraulic transmission responsible for driving the drawoff device of the snow-cutter type, the maximum power value which is not to be exceeded is measured indirectly by measuring the pressure of the oil supply to the motor, since the rate of flow of oil must remain constant to ensure a constant rate of rotation. In the event of this set value being exceeded, a pressure regulator engages a hydraulic electrodistributor in order, for example, to interrupt the supply to the hydraulic motor driving the snow-conveying device. When the drawoff device resumes a normal resistance force below the set value, measured indirectly, the supply to the motor driving the conveying device is restored, setting the snow in motion again at a predetermined constant rate. In this example, the rate is controlled by servo means which operate in an "all or nothing" mode.

One feature includes regulating the rate of the conveying device by virtue of means for continuous regulation following progressive and continuous values or following discontinuous stepwise values in order to maintain a constant resistance power of the drawoff device, for example by measuring the oil pressure, as described earlier.

The rate of flow of snow to be introduced into the duct depends, firstly, on the width of the pile of snow which is equal to that of the conveying device which is equal to that of the drawoff device, secondly on the rate of snow conveying, and thirdly on the mean height of the pile of snow. This mean height is determined by a crest-trimming device consisting of scrapers or of a conveyor belt, such as are described for the conveying device rotating in the opposite direction to that of the conveying device. The crest-trimming device is placed obliquely, its base being situated at a height equal to that determined for the pile of snow, and situated slightly in front of the drawoff device while being fastened by appropriate means to the common structure supporting the injection, drawoff and conveying devices. The height may be fixed or adjustable. The rate of rotation is determined so that excess snow is thrown back without creating an excessive force resisting the forward travel of the pile of snow when its conveying rate is at a maximum.

The conveying device and its driving means are mounted on a structure fitted with a skid or skids when it needs to travel on snow, or with wheels, particularly in the case where it is employed for removing snow from traffic ways or areas although, in this case, the use of skids is also a possibility.

The injection and drawoff devices are mounted permanently or detachably on the said structure. In the second case, the injection and drawoff devices may form a unit which can be used either on the said structure, in combination with the conveying device, or on a vehicle such as described in the abovementioned patents.

Similarly, the air generator is placed in a fixed or detachable manner on a structure fitted with a thermal or electrical motor and connected to the injection device by an air hose. This structure may be integrally fastened to a sledge which may be either pulled over the snow or placed on a vehicle. If the fastening is detachable then the air generator may be used on this sledge-structure driven by the said motor either in combination with the group of injection, drawoff and conveying devices, or in combination with vehicle-mounted injection and drawoff devices such as are described in European Patent Application No. 106,731; the air generator may also be carried by a vehicle carrying injection and drawoff devices such as described in the patents mentioned.

Another alternative form of the invention provides a drawoff device of the snow-cutter or turbo-cutter type providing several snow feed outlets, each connected to an injection device, each connected to a pneumatic conveying duct. The width of the conveying device is equal to that of the drawoff device. Thus, with a common drawoff device and a common conveying device it is possible to feed one or more conveying ducts making it possible to apply snow to a piste at a much higher rate or, equally, to apply snow to several pistes simultaneously.

Another alternative form provides for the possibility of combining several unit devices side by side. Thus, several devices which are combined transversely increase the conveying width as described in the preceding alternative form, while also making it possible to feed several ducts simultaneously.

Another alternative form envisages combining with the conveying device connected to its drawoff and injection device, one or more other devices for conveying in the lengthwise direction for the purpose of increasing linearly the stock of snow capable of being conveyed in a straight line or along a curve divided into sections by each of the conveying devices.

The process and the apparatus which are thus provided considerably improve the operating conditions of pneumatic snow conveying, through the appreciable increase in the average rate of flow of the snow which is drawn off and through the reduction in the operating costs resulting from not immobilizing a high-powered carrier vehicle. Additionally, the pneumatic efficiency is improved by virtue of the use of injectors which are adequately sealed, in contrast to the conveying and introduction screws described in Patent FR-A-2,289,414. Moreover, the operation is simplified since the operator's task consists merely of pushing or loading the snow onto the conveying device.

Figure 2:
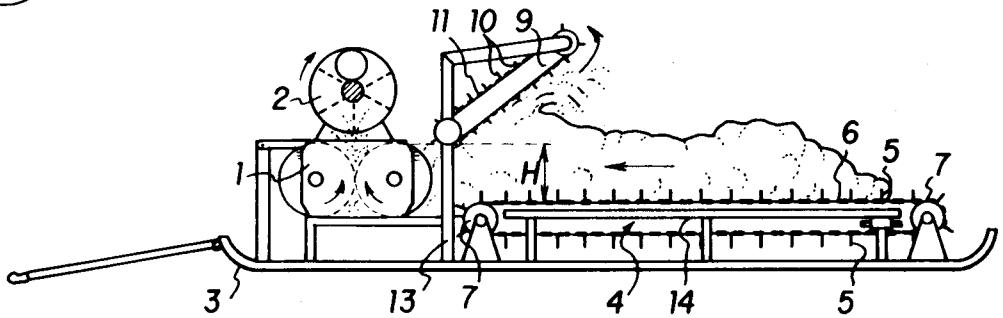
FIG. 2 is a side view of the embodiment of the invention shown in FIG. 1, including the combination of the conveying, drawoff and injection devices.

As can be seen in FIGS. 1 and 2, in order to drawoff snow, the drawoff device 1 is in a stationary unit form, as is the injection device 2 of the rotary lockchamber type. Both are fastened onto the sledge 3.

Also fastened onto this same sledge 3 is the conveying device 4 which comprises the snow-driving scrapers 5, which are attached at their ends to two side chains 6. The latter turn around roller wheels 7, at least two of which are driven by a mechanical transmission or a motor 8. A hydraulic motor is shown in the present embodiment. The movement of the scrapers 5 which slide over the floor 14, drives the snow thereon against the drawoff device 1 which cuts it off and conveys it into the injector 2. As can be seen in FIG. 2, the drawoff device 1 is preferably placed tangentially with respect to the conveying floor 14.

To ensure a constant snow thickness in front of the drawoff device 1, the conveying device comprises a crest-trimming device 9 which rotates in the opposite direction to that of the scrapers 5. Thus, surplus snow is thrown backwards onto the device for driving the snow in translation.

The crest-trimming device 9 consists of scrapers 10 which are attached to two chains 11 driven by a mechanical transmission or by a motor 12, hydraulic in the present example. The crest-trimming device is attached to a structure 13 which is integrally fastened to the sledge 3.

Referring to FIG. 1, the case where the snow is pushed onto the conveying device 4 by a pusher vehicle 15, only one side rack 16 is maintained in a vertical position in order to hold the snow. The other two racks, side and rear, may be either folded down (17) or may be removed (rear).

In the case where loading is done by a loader vehicle, it is advantageous to leave the three racks in a vertical position.

The air generator 18 is connected to the injector 2 by a hose 19. The motors driving the various devices are supplied by pumps which are driven, in a coupled manner or independently, by a motor which is either thermal, electrical, or hydraulic. In the preferred embodiment shown in FIG. 1, the motors driving the various devices are hydraulic motors 8, 23 and the motor driving the pumps supplying these devices is a thermal motor 20. Referring to FIG. 1, the thermal motor 20, the air generator 18 and their associated equipment, are fastened onto a sledge 21.

Figure 3:
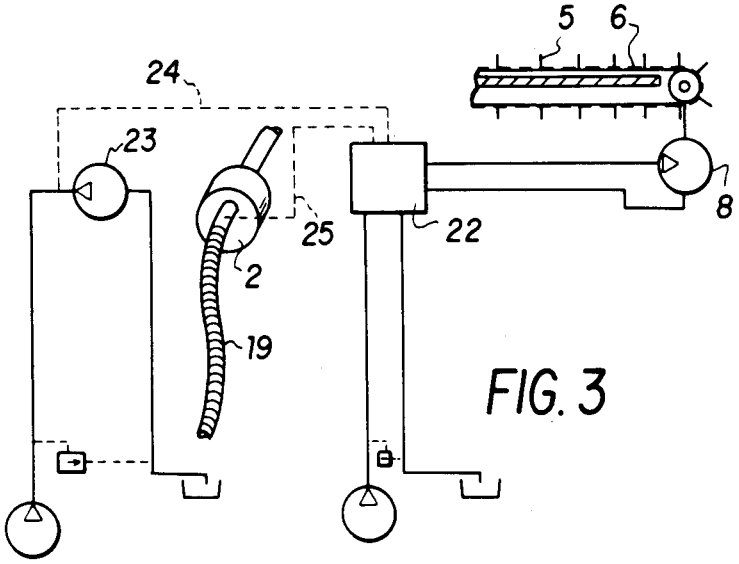
FIG. 3 is a diagram of the system for servo control of the speed of the conveying devices by the oil supply pressure of the motor of the drawoff device in the embodiment shown in FIGS. 1 and 2.

The speed at which the scrapers 5 are driven and hence the rate of snow conveying, is controlled by a servo device 22, as can be seen in FIGS. 1 and 3. This servo device receives as data the oil pressure of the hydraulic motor 23 of the drawoff device 1 via a small conduit 24.

The servo device 22 changes the supply to the hydraulic motor 8 of the conveying device 4 either by interrupting this supply by means of an electrodistributor, for example, when the said oil pressure exceeds a predetermined value, or by varying the rate of supply to the motor 8, and hence the rate at which the snow is driven, in order to maintain a constant oil pressure at the supply to the motor 23. This speed change is a function of snow consistency, which determines the power consumed by the motor of the drawoff device 1. In this case, the servo device changes, for example, the setting of the variable cylinder capacity of the pump supplying the motor 8.

This servo device may additionally or independently take into account the pneumatic power measured, for example, by means of the air pressure inside the duct. In order to perform this servo control, as shown in FIG. 3, a pneumatic pressure controller receives the air pressure through a small conduit 25 connected to the air duct 19. This pressure controller operates by sending a signal which controls the hydraulic supply to the motor 8 by an all-or-nothing action or by discontinuous or continuous action, according to known control techniques. That is, generally the conveying device operates at a constant rate. However, when the resisting power of the motor 23 of the drawoff device 1 reaches a predetermined value, such that the motor 23 can not handle all of the snow introduced by the conveying device 4, the servo control 22 sends a signal to the motor 8 of the conveying device 4 which stops the conveying device 4. Snow continues to enter the drawoff device 1, however the amount of snow is reduced to permit the resisting power of the motor 23 to be reduced. Once the resisting power of the motor 23 reaches an acceptable level, the servo control 22 sends a signal to motor 8 of conveying device 4 to resume the conveying process.

Figure 4:
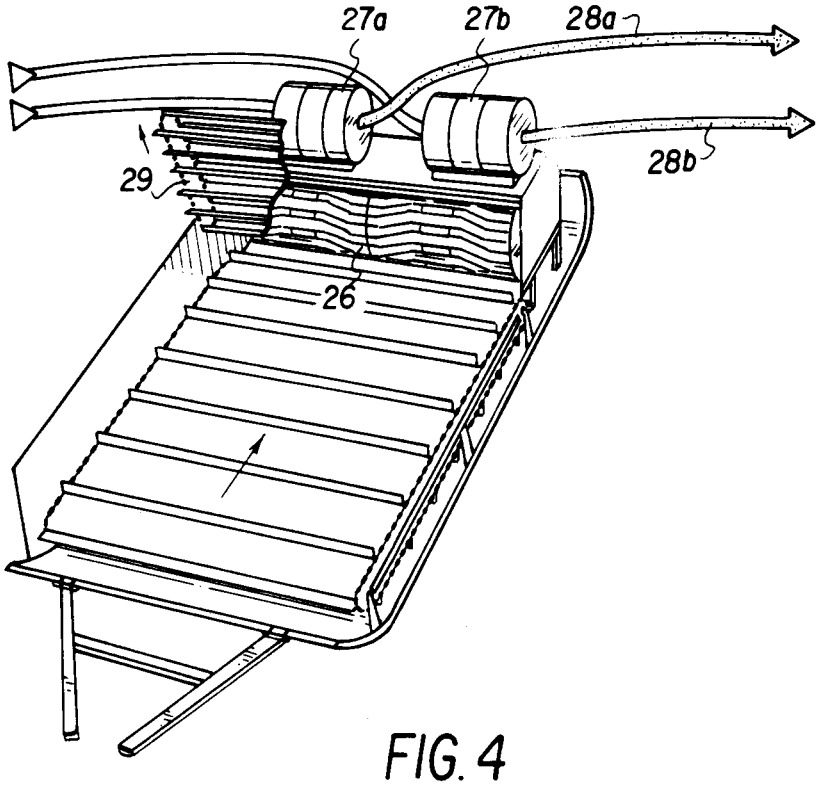
FIG. 4 is a perspective view of another preferred embodiment of the invention, including an alternative form of a conveying device common to a drawoff device with two feed orifices and common to two injection devices and to two ducts.

An alternative embodiment of the process provides for the use of a drawoff device with two or more feed outlets and served by a single conveying device, as can be seen in FIG. 4.

A single cutter 26 with two outlets feeds two injection devices 27*a* and 27*b* which are connected, respectively, to the snow-conveying ducts 28*a* and 28*b*. The crest-trimming device 29 is also common.

Figure 5:
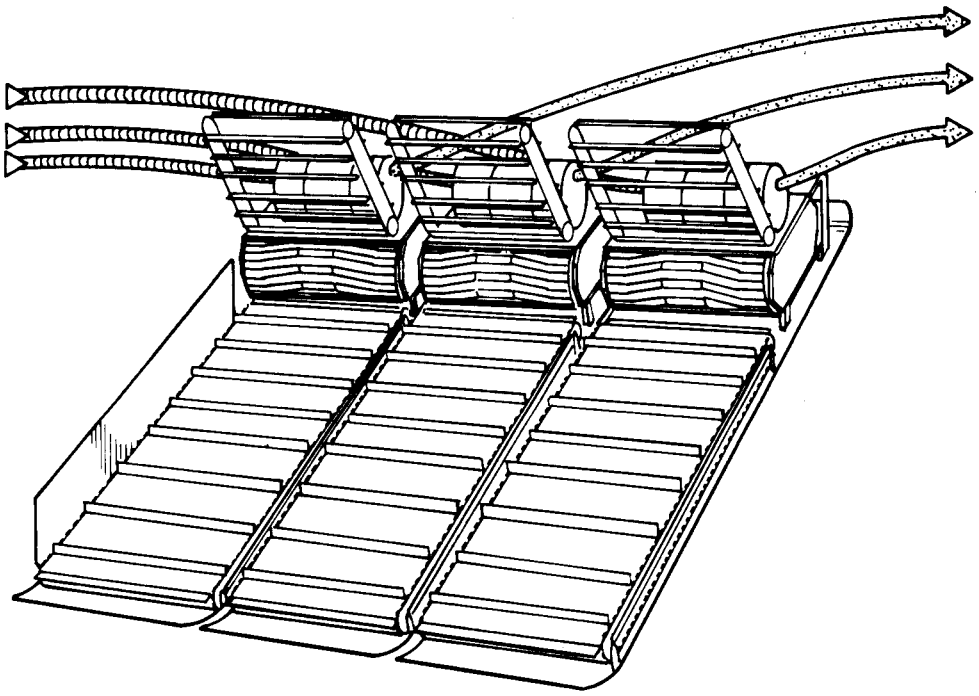
FIG. 5 is a perspective view of another preferred embodiment of the invention, including an assembly of three unit devices enabling three ducts to be fed simultaneously.

As shown in FIG. 5, another alternative embodiment of the invention includes combining several independent devices. This arrangement permits a very flexible use of the process, especially in order to distribute the drawoff devices at a number of sites where snow is accumulated or, on the contrary, to maximize the rate of drawing off at a single site.

Figure 6:
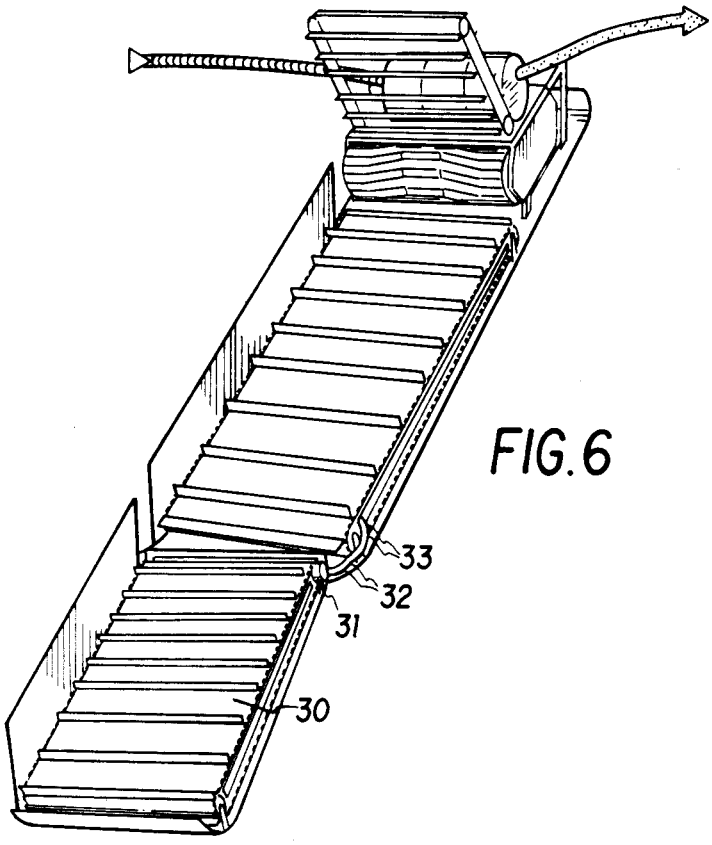
FIG. 6 is a perspective view of another preferred embodiment of the invention, including an additional conveying device placed as a linear extension of a unit device.

As can be seen in FIG. 6, a supplementary conveying device 30 is combined linearly with the main device.

As in the preceding alternative forms, this supplementary device 30 makes is possible to increase the quantity of snow which is stored on the conveying device without, however, increasing the rate of drawing off and of conveying. It is advantageous when the pusher vehicle or the loader vehicle needs to collect the snow over a wide area, the conveying time required being longer than the time for ingesting the snow with a single conveying device. This supplementary device 30 does not comprise a crest-trimming device. It is driven by a mechanical transmission or by a hydraulic motor 31, for example, which is connected to a hydraulic supply circuit by hoses 32 and fast couplings 33.

It is obvious that for reasons of convenience of use or of transport on site, the drawoff and injection devices may be fastened detachably or otherwise onto a structure which is independent of that of the conveying device. In this case, the two structures are placed end to end during operation, so that the snow conveyed may be cut off by the drawoff device.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

What I claim is:

1. A device for conveying snow for snow application or snow removal, comprising:

conveying means for conveying a pile of snow;

first control means for controlling the rate of travel of the snow on said conveying means;

second control means for controlling the height of the snow on said conveying means;

a drawoff device for receiving the conveyed snow;

an injecting device operatively connected to said drawoff device for receiving the snow from said drawoff device and injecting the snow into conveying ducts, said injecting device and said drawoff device forming a stationary unit;

an air generator operatively connected to said injecting device for introducing air into said injecting device to produce a mixture of air and snow in said injecting device that is released into the conveying ducts;

means for driving each of said conveying means, injecting device, drawoff device and air generator.

2. A device according to claim 1, wherein the rate of travel of the snow on the conveying means is controlled as a function of the power required to drive the drawoff device in order to keep said power at or below a predetermined value.

3. A device according to claim 1, wherein the rate of travel of the snow on the conveying means is controlled as a function of the power required to drive the air generator in order to keep said power at or below a predetermined value.

4. A device according to claim 1, wherein said first control means includes a servo means operative to stop the conveying means when the amount of snow entering the drawoff device reaches a predetermined value and to actuate the conveying means when the amount of snow entering the drawoff device goes below said predetermined value.

5. A device according to claim 1, wherein said first control means includes servo means operating continuously according to progressive and continuous values.

6. A device according to claim 1, wherein said first control means includes servo means operating according to intermittent discontinuous values.

7. A device according to claim 1, wherein said second control means includes a fixed frame positioned above said conveying means to prevent snow above a predetermined height from entering the drawoff device.

8. A device according to claim 1, wherein said second control means includes an adjustable frame positioned above said conveying means to prevent snow above a predetermined height from entering the drawoff device.

9. A device for conveying snow from one selected location to another selected location, for snow removal or snow application, comprising:

conveying means for conveying a pile of snow along a first support in a direction away from said one selected location;

first control means for controlling the rate of travel of said snow on said conveying means;

second control means for controlling the height of the snow on the conveying means;

conveying ducts for conveying the snow to said other selected location;

means for drawing the snow from said conveying means and into said conveying ducts, said drawing means including a drawoff device for receiving the snow from the conveying means and an injecting device operatively connected to said drawoff device for injecting the snow into said conveying ducts, said drawoff device and said injecting device forming a stationary unit;

an air generator operatively connected to said injecting device for introducing air into said injecting device to produce a mixture of air and snow in the injecting device that is released into the conveying ducts;

means for driving each of said conveying means, injecting device, drawoff device, and air generator.

10. A device according to claim 9, wherein said conveying means includes a conveyor belt fitted with a plurality of transverse grips for conveying the snow.

11. A device according to claim 9, wherein said conveying means includes two endless chains driven in spaced relation along said first support and a plurality of transverse grips fitted at each end to a corresponding one of the chains.

12. A device according to claim 9, wherein the second control means is a crest-trimming device positioned proximate said drawoff device at an angle above the conveying means, said crest-trimming device including a conveyor belt with transverse projections operative in a direction opposite to the direction of the conveying means for pushing snow above a predetermined height away from said drawoff device, the base of said crest-trimming device being adjustable to a height not exceeding the height of said drawoff device.

13. A device according to claim 9, wherein the second control means is a crest-trimming device positioned proximate said drawoff device at an angle above said conveying means, said crest-trimming device including two endless chains in spaced relation and a plurality of transverse projections fitted at each end to a corresponding one of the chains, said chains being operative in a direction opposite to the direction of the conveying means for pushing snow above a predetermined height away from said drawoff device, the base of said crest-trimming device being adjustable to a height not exceeding the height of said drawoff device.

14. A device according to claim 9, wherein said drawoff device and injecting device are removably mounted on said first support for permitting separate use.

15. A device according to claim 9, wherein said drawoff device and injecting device are fixed to said first support.

16. A device according to claim 9, said device further comprising a second support, wherein said drawoff device and said injecting device are mounted on said second support and wherein said first support and said second support are positioned adjacent one another during operation.

17. A device according to claim 9, wherein said conveying means includes at least two conveyor belts arranged end to end for successively conveying snow, each conveyor belt being mounted on a separate support.

18. A device according to claim 9, wherein the drawing device, injecting device, conveying means, and second control means are mounted on a sledge.

19. A device according to claim 9, wherein at least two of said devices are arranged side to side for conveying an increased amount of snow.

* * * * *